US011883924B2

(12) United States Patent
Maruta

(10) Patent No.: US 11,883,924 B2
(45) Date of Patent: Jan. 30, 2024

(54) DOUBLE-SIDED POLISHING APPARATUS

(71) Applicant: Fujikoshi Machinery Corp., Nagano (JP)

(72) Inventor: Masashi Maruta, Nagano (JP)

(73) Assignee: Fujikoshi Machinery Corp., Nagano (JP)

( * ) Notice: Subject to any disclaimer, the term of this patent is extended or adjusted under 35 U.S.C. 154(b) by 0 days.

(21) Appl. No.: 18/341,115

(22) Filed: Jun. 26, 2023

(65) Prior Publication Data

US 2023/0415298 A1 Dec. 28, 2023

(30) Foreign Application Priority Data

Jun. 27, 2022 (JP) ..... 2022-102992

(51) Int. Cl.
*B24B 37/08* (2012.01)
*B24B 37/005* (2012.01)

(52) U.S. Cl.
CPC ..... *B24B 37/08* (2013.01); *B24B 37/005* (2013.01)

(58) Field of Classification Search
CPC ..... B24B 37/08; B24B 37/28; B24B 37/042; B24B 49/10; B24B 49/12; B24B 49/105; B24B 49/02; B24B 49/04
See application file for complete search history.

(56) References Cited

U.S. PATENT DOCUMENTS 4,272,924 A * 6/1981 Masuko ..... B24B 37/08 451/287
4,433,510 A * 2/1984 Katagiri ..... B24B 37/08 324/229

(Continued)

FOREIGN PATENT DOCUMENTS

JP 2008-227393 9/2008
JP 2017-207455 11/2017
WO WO-2016021094 A1 * 2/2016 ..... B24B 37/28

*Primary Examiner* — Joel D Crandall
(74) *Attorney, Agent, or Firm* — Stephen J. Weyer, Esq.; Stites & Harbison, PLLC

(57) ABSTRACT

A double-sided polishing apparatus includes: a lower surface plate; an upper surface plate; and a carrier disposed between the lower surface plate and the upper surface plate and holding a disk-shaped workpiece, wherein the carrier is configured to rotate about a center of the lower surface plate and the upper surface plate and to rotate about a center of the carrier, the double-sided polishing apparatus includes a thickness measuring sensor at a fixed position above the upper surface plate or below the lower surface plate or at a movable position in an upper portion of the upper surface plate or a lower portion of the lower surface plate, the carrier includes circular perforations each holding the workpiece at a position eccentric to the center of the carrier, when a central position of any of the perforations preset by a user is defined as a first reference position, with a distance between a center of the upper surface plate or the lower surface plate and a center of any of the perforations preset by the user being shortest or longest, and a position apart from the first reference position by half of a first distance in a direction of the center of the carrier is defined as a second reference position, with the first distance being a predetermined length within 30% of a radius of the perforation, then the thickness measuring sensor is provided in a range of the first distance about the second reference position in a plan view, and the thickness measuring sensor is configured to measure a thickness of the workpiece in a state in which the workpiece is held in the perforation, through a measuring hole provided on the upper surface plate or the lower surface plate closer to a side on which the thickness measuring sensor is disposed.

8 Claims, 8 Drawing Sheets

(56) References Cited

U.S. PATENT DOCUMENTS

| | | | | |
|---|---|---|---|---|
| 2006/0040589 | A1* | 2/2006 | Ising | B24B 37/08 451/8 |
| 2015/0065010 | A1* | 3/2015 | Miura | B24B 37/013 451/262 |
| 2018/0056478 | A1* | 3/2018 | Kanzow | B24B 37/08 |

* cited by examiner

DOUBLE-SIDED POLISHING APPARATUS

CROSS-REFERENCE TO RELATED APPLICATION

This application is based upon and claims the benefit of priority of the prior Japanese Patent Application No. 2022-102992, filed on Jun. 27, 2022, and the entire contents of which are incorporated herein by reference.

TECHNICAL FIELD

The present invention relates to a double-sided polishing apparatus that polishes upper and lower surfaces of a workpiece such as a wafer.

BACKGROUND ART

A double-sided polishing apparatus that holds a wafer (often referred to as "workpiece" in the present application) held in a carrier between upper and lower surface plates and polishes the wafer is known. According to PTL 1 (JP2008-227393A), such a double-sided polishing apparatus includes a thickness measuring sensor provided on a support frame that is disposed above the upper surface plate. Furthermore, a window (corresponding to "measuring hole") is provided on the upper surface plate. A laser beam of the thickness measuring sensor passes through the window of the rotating upper surface plate to allow the thickness measuring sensor to acquire a thickness of the workpiece immediately under the window. According to PTL 2 (JP2017-207455A), a thickness on a trajectory on which a workpiece thickness measuring hole provided at a position apart radially outward from a center of the upper surface plate by a predetermined distance passes through the workpiece (hereinafter, often simply referred to as "pass trajectory") is acquired to acquire a thickness distribution of the workpiece during machining

SUMMARY OF INVENTION

Technical Problem

In the double-sided polishing apparatuses disclosed in PLT 1 and PTL 2, the carrier that holds the workpiece is rotated about a center of the lower surface plate and the upper surface plate (revolves in a direction C) and also rotated about a center of the carrier (rotates on an axis of the carrier in a direction D), as illustrated in, for example, FIG. 1. Moreover, in the double-sided polishing apparatus disclosed in PTL 2, the upper or lower surface plate provided with the measuring hole or the thickness measuring sensor is rotated in an opposite direction to a revolution direction of the carrier. Further, the workpiece is held at a position eccentric to the center of the carrier. With these configurations, a trajectory of a center of the workpiece is complex like, for example, a trochoid curve. As disclosed in PTL 2, when the upper or lower surface plate provided with the measuring hole or the thickness measuring sensor is rotated, the trajectory of the center of the workpiece with respect to the measuring hole and the thickness measuring sensor is more complicated.

On the other hand, even if provided in any location in a height direction of the double-sided polishing apparatus, the thickness measuring sensor desirably acquires the thickness of the workpiece when the measuring hole and the thickness measuring sensor passing through near the center of the workpiece. However, it is difficult to locate a range in which the measuring hole or the thickness measuring sensor passing through near the center of the workpiece more frequently is disposed with respect to the complex pass trajectory. More specifically, when a user sets data acquisition ranges as being near the center of the workpiece, it is difficult to locate the range of the measuring hole or the thickness measuring sensor more frequently passing through such data acquisition ranges.

Solution to Problem

The present invention has been accomplished to solve the problems, and an object of the present invention is to provide a double-sided polishing apparatus including a measuring hole and a thickness measuring sensor disposed in a range in which the measuring hole and the thickness measuring sensor pass through a set data acquisition range with higher frequency.

A double-sided polishing apparatus according to the present invention includes: a lower surface plate; an upper surface plate; and a carrier disposed between the lower surface plate and the upper surface plate and holding a disk-shaped workpiece, wherein the carrier is configured to rotate about a center of the lower surface plate and the upper surface plate and to rotate about a center of the carrier, the double-sided polishing apparatus includes a thickness measuring sensor at a fixed position above the upper surface plate or below the lower surface plate or at a movable position in an upper portion of the upper surface plate or a lower portion of the lower surface plate, the carrier includes circular perforations each holding the workpiece at a position eccentric to the center of the carrier, when a central position of any of the perforations preset by a user is defined as a first reference position, with a distance between a center of the upper surface plate or the lower surface plate and a center of any of the perforations preset by the user being shortest or longest, and a position apart from the first reference position by half of a first distance in a direction of the center of the carrier is defined as a second reference position, with the first distance being a predetermined length within 30% of a radius of the perforation, then the thickness measuring sensor is provided in a range of the first distance about the second reference position in a plan view, and the thickness measuring sensor is configured to measure a thickness of the workpiece in a state in which the workpiece is held in the perforation, through a measuring hole provided on the upper surface plate or the lower surface plate closer to a side on which the thickness measuring sensor is disposed.

A double-sided polishing apparatus according to the present invention includes: a lower surface plate; an upper surface plate; and a carrier disposed between the lower surface plate and the upper surface plate and holding a triangular, rectangular, square, or polygonal flat-plate workpiece, wherein the carrier is configured to rotate about a center of the lower surface plate and the upper surface plate and to rotate about a center of the carrier, the double-sided polishing apparatus includes a thickness measuring sensor at a fixed position above the upper surface plate or below the lower surface plate or at a movable position in an upper portion of the upper surface plate or a lower portion of the lower surface plate, the carrier includes circular perforations each holding the workpiece at a position eccentric to the center of the carrier and each having an identical shape to the workpiece, when a central position of any of the perforations preset by a user is defined as a first reference position, with a distance between a center of the upper surface plate or the lower surface plate and a center of a circumscribed circle of all vertexes of any of the perforations preset by the user being shortest or longest, and a position apart from the first reference position by half of a first distance in a direction of the center of the carrier is defined as a second reference position, with the first distance being a predetermined length within 30% of a radius of the circumscribed circle, the thickness measuring sensor is provided in a range of the first distance about the second reference position in a plan view, and the thickness measuring sensor is configured to measure a thickness of the workpiece in a state in which the workpiece is held in the perforation, through a measuring hole provided on the upper surface plate or the lower surface plate closer to a side on which the thickness measuring sensor is disposed.

According to these configurations, it is possible to increase frequency with which the measuring hole and the thickness measuring sensor pass through the data acquisition range preset by the user.

It is also preferable that the central position of the perforation or the center position of the circumscribed circle of the perforation at which a distance between the center of the upper surface plate or the lower surface plate and the center of the perforation or the center of the circumscribed circle is the shortest is set as the first reference position. According to this configuration, the thickness measuring sensor can be disposed on an inner circumferential side of the surface plate, causing a passing speed (circumferential speed) of the measuring hole and the thickness measuring sensor when the measuring hole and the thickness measuring sensor passe on the workpiece to be lower than a case where the measuring hole and the thickness measuring sensor are disposed on an outer circumferential side of the surface plate. Therefore, the thickness of the workpiece can be acquired correctly and precisely. In addition, a measuring interval of measuring the thickness of the workpiece becomes smaller, enabling the acquisition of the highly precise thickness distribution.

Advantageous Effects of Invention

According to the present invention, it is possible to realize a double-sided polishing apparatus with high acquisition frequency of a thickness and a thickness distribution corresponding to a pass trajectory when a measuring hole and a thickness measuring sensor pass through a set data acquisition range.

DESCRIPTION OF EMBODIMENTS

First Embodiment

Figure 1:
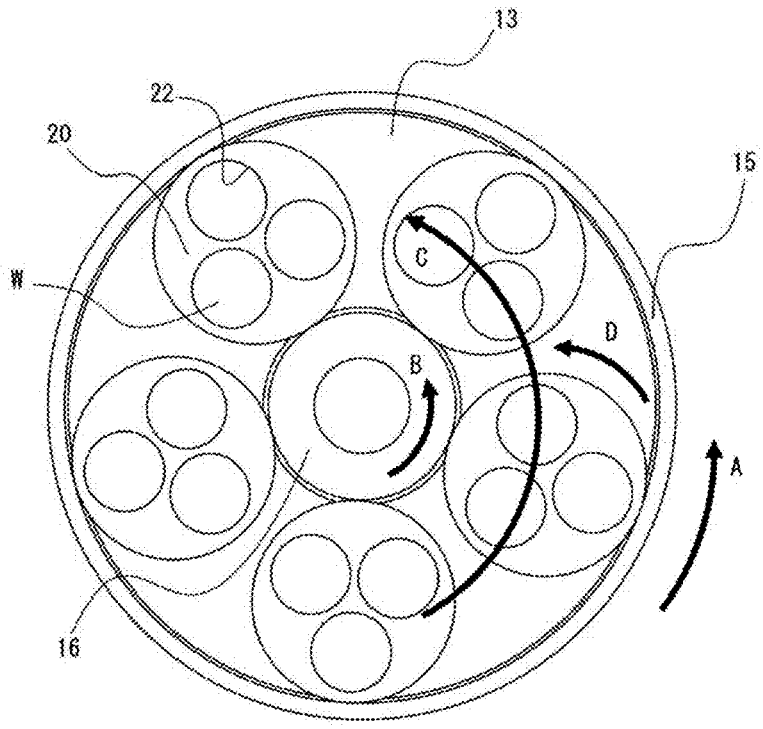
FIG. 1 is an explanatory diagram illustrating an example of a relationship between a rotation about an own axis and a revolution of a carrier according to embodiments of the present invention.
Figure 2:
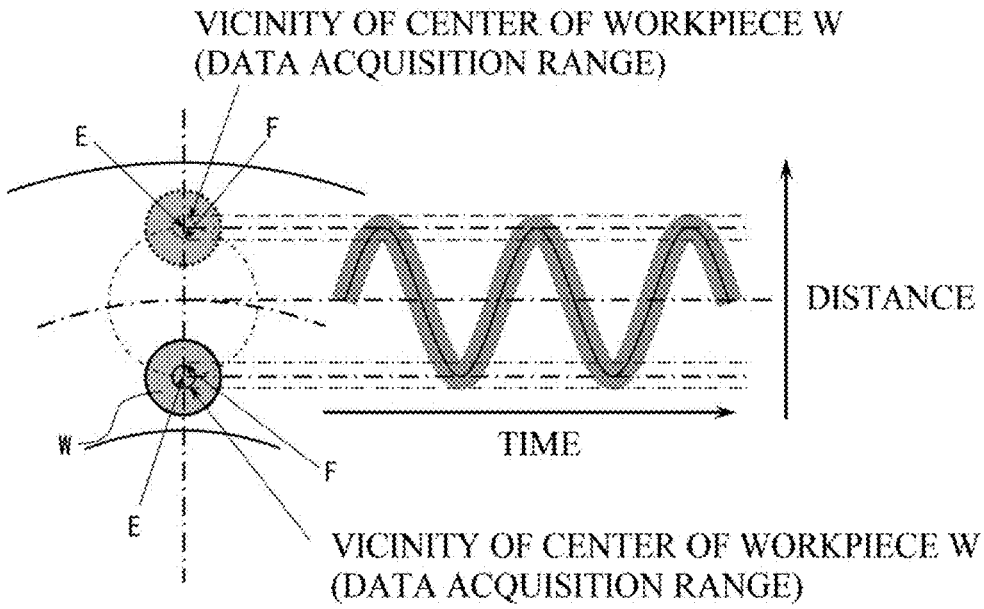
FIG. 2 is an explanatory diagram illustrating a state of a change near a center of a workpiece (data acquisition range) with a horizontal axis defined as a time and a vertical axis defined as distance from a center of a lower surface plate and an upper surface plate.
Figure 3:
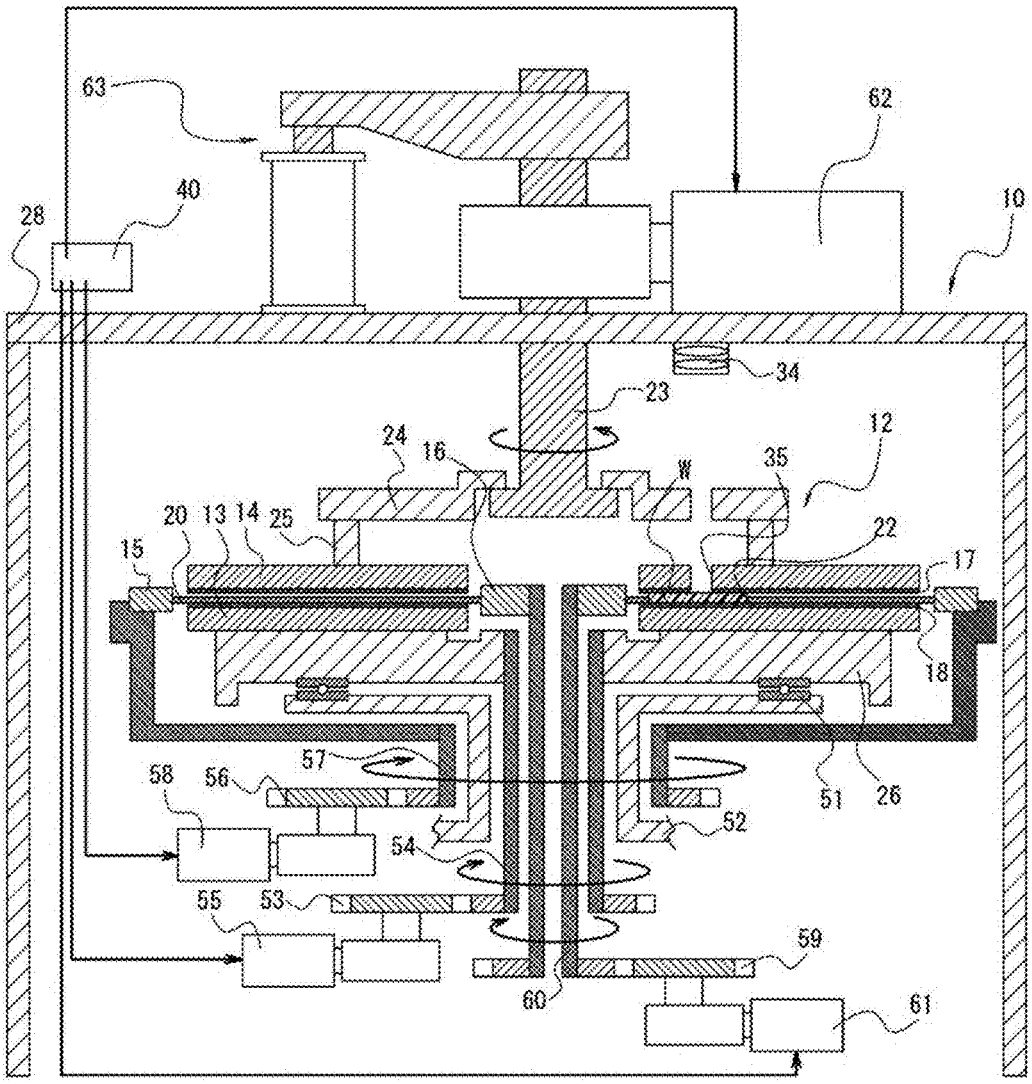
FIG. 3 is a front view of a double-sided polishing apparatus according to a first embodiment of the present invention.
Figure 4:
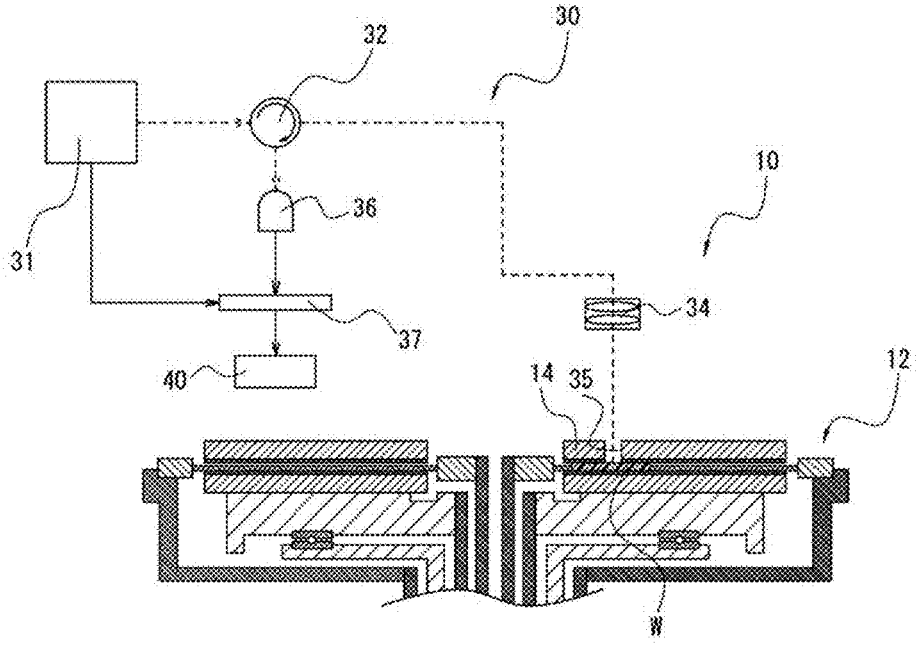
FIG. 4 is a block diagram of a thickness measuring section in the double-sided polishing apparatus illustrated in FIG. 3.
Figure 5:
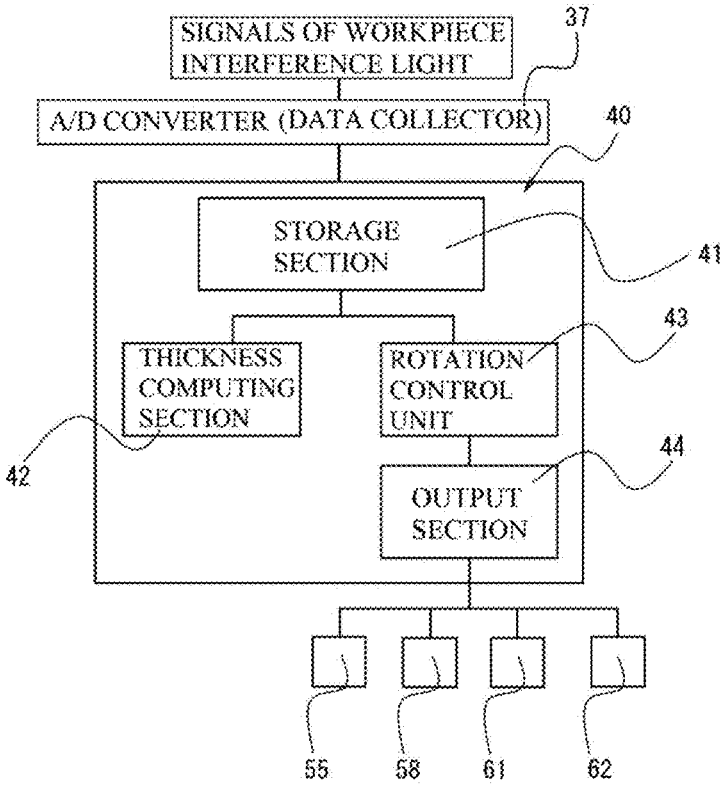
FIG. 5 is a block diagram of a control unit in the double-sided polishing apparatus illustrated in FIG. 3.

Embodiments of the present invention will be described hereinafter in detail with reference to the drawings. FIG. 1 is an explanatory diagram illustrating a relationship between rotation and revolution of a carrier 20 according to first and second embodiments. FIG. 2 is an explanatory diagram illustrating a state of a change in the vicinity of a center of a workpiece W (data acquisition range) with a horizontal axis defined as a time and a vertical axis defined as distance from a center of a lower surface plate 13 and an upper surface plate 14. FIG. 3 is a front view of a double-sided polishing apparatus 10 according to the first embodiment of the present invention. FIG. 4 is a block diagram of a thickness measuring section 30 in the double-sided polishing apparatus 10 illustrated in FIG. 3. FIG. 5 is a block diagram of a control unit 40 in the double-sided polishing apparatus 10 illustrated in FIG. 3. It is noted that members having the same function are denoted by the same reference sign and not repeatedly described in all the drawings for describing the present embodiment.

In the present embodiment, a range of disposing a thickness measuring sensor 34 with reference to a central position of a circular perforation 22 provided in each carrier 20 will first be described. When a workpiece W is disk-shaped and held in the perforation 22 without a gap, the disposing range may be set with reference to a central position of each workpiece W. In addition, when the perforation 22 is triangular, rectangular, square, or polygonal-shaped, the disposing range may be set with reference to a central position of a circumscribed circle of all vertexes of the perforation 22. When a workpiece W is held in the perforation 22 without a gap, the disposing range may be set with reference to a central position of a circumscribed circle of all vertexes of the workpiece W.

Next, when the workpiece W is disk-shaped, the "vicinity of the center of the workpiece W" is defined as a "range within 30% of a radius of the perforation 22 (workpiece W)" from the center of the perforation 22 (workpiece W) in the present embodiment. In addition, when the workpiece W is triangular, rectangular, square, or polygonal-shaped, the "vicinity of the center of the workpiece W" is defined as a "range within 30% of a radius of the circumscribed circle of the perforation 22 (workpiece W) from the center of the circumscribed circle of all vertexes of the perforation 22 (workpiece W)" in the present embodiment. Even with the workpiece W not being disk-shaped, the vicinity of the center of the workpiece W is a circular range.

Furthermore, the "data acquisition range" is a range in which thickness data on a pass trajectory of passing through this range should be acquired, and that is set within an arbitrary distance from the center of the workpiece W or the center of the circumscribed circle of the workpiece W (hereinafter, often simply referred to as "distance specifying the data acquisition range") depending on a purpose. In the present embodiment, the "data acquisition range" is defined as, for example, a "range that is within 30% of either the radius of the perforation 22 (workpiece W) or the radius of the circumscribed circle of all vertexes of the perforation 22 (workpiece W) from either the center of the perforation 22 (workpiece W) or the center of the circumscribed circle of the perforation 22 (workpiece W) and in which the thickness data on the pass trajectory of passing through this range should be acquired." That is, the data acquisition range is a value to be preset by a user. This enables the acquisition of the thickness data on the pass trajectory of passing through the range "near the center of the workpiece W" preset by the user. Furthermore, a "first distance G" to be described later is a distance that forms the basis for determining the disposing range of a measuring hole 35 and the thickness measuring sensor 34, and is preferably configured to be set in conjunction with the data acquisition range. That is, when the user presets the data acquisition range, the first distance G is also set as a predetermined length within 30% of either the radius of the perforation 22 (workpiece W) or the radius of the circumscribed circle of all vertexes of the perforation 22 (workpiece W). It is noted that the first distance G is dealt with as, for example, the same distance as the distance specifying the data acquisition range according to the present embodiment. The double-sided polishing apparatus 10 according to each embodiment identifies a disposing range in which the measuring hole 35 and the thickness measuring sensor 34 pass through the data acquisition range preset by the user with higher frequency. More specifically, the double-sided polishing apparatus 10 according to each embodiment identifies the disposing range in which the measuring hole 35 and the thickness measuring sensor 34 pass through the range of the "vicinity of the center of the workpiece W" preset by the user with higher frequency.

Moreover, in the first embodiment, the "measuring hole 35 and the thickness measuring sensor 34 pass through the workpiece W" indicates a state in which the upper surface plate 14 or the lower surface plate 13 is rotated to cause the measuring hole 35 to pass through the workpiece W and to allow the thickness measuring sensor 34 to measure the thickness or thickness distribution of the workpiece W through the measuring hole 35. In a second embodiment, to be described later, the "measuring hole 35 and the thickness measuring sensor 34 pass through the workpiece W" indicates a state in which the upper surface plate 14 or the lower surface plate 13 is rotated to cause the measuring hole 35 to pass through the workpiece W. In the second embodiment, the measuring hole 35 and the thickness measuring sensor 34 are provided at the same position in a plan view; therefore, once the measuring hole 35 passes through the workpiece W, the thickness measuring sensor 34 can measure the thickness or thickness distribution of the workpiece W through the measuring hole 35.

(Double-Sided Polishing Apparatus)

Next, as illustrated in FIGS. 3, 4, and 5, the double-sided polishing apparatus 10 according to the present embodiment is configured with a main body 12 that polishes both surfaces of the workpiece W, the thickness measuring section 30 that measures time series data about the thickness of the workpiece W during polishing, and the control unit 40 that controls cross-sectional shape measurement and a rotation speed of the carrier 20.

On the other hand, the workpiece W to be polished is a flat plate-shaped (disk-shaped, in particular) workpiece W such as a wafer (e.g., silicon wafer) and an outside diameter and the thickness of the workpiece W are not limited to specific ones (e.g., the outside diameter may be approximately several cm to several tens cm and the thickness may be approximately a few μm to several mm) Alternatively, the workpiece W may be a flat plate workpiece W (triangular, rectangular, square, or polygonal workpiece W, in particular), and dimensions and the thickness of the workpiece W are not limited to specific ones (e.g., the diameter of the circumscribed circle of all vertexes of the rectangle may be approximately several cm to several tens cm, and the thickness may be approximately several μm to several mm) It is noted that the circumscribed circle of the workpiece W can be regarded as a region of the workpiece W in each control by the control unit 40 to be described later and each embodiment to be described later.

The main body 12 of the double-sided polishing apparatus 10 according to the present embodiment is configured with, for example, the lower surface plate 13, the upper surface plate 14, an internal gear 15 disposed on outer circumferential sides of the lower surface plate 13 and the upper surface plate 14, a sun gear 16 disposed to be rotatable between central portions of the lower surface plate 13 and the upper surface plate 14, and the carriers 20 disposed between the lower surface plate 13 and the upper surface plate 14. Furthermore, polishing pads 17, 18 are affixed to an upper surface of the lower surface plate 13 and the lower surface of the upper surface plate 14, respectively.

Next, the lower surface plate 13 according to the present embodiment is formed into a circular shape in a plan view using a metal material (e.g., a stainless alloy), and placed on a surface plate receiver 26 so that the lower surface plate 13 can rotate as illustrated in FIG. 3. The surface plate receiver 26 is supported by a base 52 via bearings 51. Furthermore, the surface plate receiver 26 is configured to be driven to rotate by a rotary drive (e.g., a drive equipped with an electric motor) 55, and a drive force of the rotary drive 55 is transmitted to the surface plate receiver 26 via a power transmission gear 53 and a cylindrical shaft 54. As the surface plate receiver 26 is driven to rotate, the lower surface plate 13 is rotated, as well.

Next, the upper surface plate 14 according to the present embodiment is formed into a circular shape in a plan view using a metal material (e.g., a stainless alloy), and suspended by a disk 24 via rods 25 so that the upper surface plate 14 can rotate as illustrated in FIG. 3. The disk 24 is supported by a support frame 28 via a suspension post 23 so that the disk 24 can move vertically and rotate freely. The suspension post 23 is configured to be driven to move vertically and to rotate by a rotary drive (e.g., a drive equipped with an electric motor) 62 and a vertical movement drive 63. As the suspension post 23 and the disk 24 are driven to rotate, the upper surface plate 14 is rotated, as well. It is noted that the upper surface plate 14 and the lower surface plate 13 are rotated in opposite directions.

Moreover, in FIG. 3, the upper surface plate 14 is provided with the measuring hole 35 at the same position as the thickness measuring sensor 34, to be described later, in a plan view. That is, a distance from the center of the upper surface plate 14 to the thickness measuring sensor 34 in the plan view is equal to a distance from the center of the upper surface plate 14 to the measuring hole 35. Since the upper surface plate 14 rotates, the thickness measuring sensor 34 and the measuring hole 35 are configured to overlap each other in the plan view in a predetermined rotation phase. A window, not illustrated, is provided on a side of the measuring hole 35 closer to the workpiece W. The window is made of, for example, glass.

Next, the internal gear 15 according to the present embodiment is formed on the outer circumferential side of the lower surface plate 13 using a metal material (e.g., a stainless alloy) with an axial center of the internal gear 15 coincident with those of the lower surface plate 13 and the upper surface plate 14, as illustrated in FIG. 3. The internal gear 15 is driven to rotate, for example, in a direction A by a rotary drive (e.g., a drive equipped with an electric motor) 58, and a drive force of the rotary drive 58 is transmitted to the internal gear 15 via a power transmission gear 56 and a cylindrical shaft 57.

Next, the sun gear 16 according to the present embodiment is formed on a center-side upper portion of the lower surface plate 13 and a center-side lower portion of the upper surface plate 14 using a metal material (e.g., a stainless alloy) with an axial center of the sun gear 16 coincident with those of the lower surface plate 13 and the upper surface plate 14, as illustrated in FIG. 3. The sun gear 16, like the internal gear 15, is driven to rotate, for example, in a direction B by a rotary drive (e.g., a drive equipped with an electric motor) 61, and a drive force of the rotary drive 61 is transmitted to the sun gear 16 via a power transmission gear 59 and a cylindrical shaft 60. The number of teeth of each carrier 20, the number of teeth of the sun gear 16, the number of teeth of the internal gear 15, a rotation speed and a rotation direction of the sun gear 16, and a rotation speed and a rotation direction of the internal gear 15 determine a rotation speed and a rotation direction of the rotation of the carrier 20 about the own axis and a revolution speed and a revolution direction of the carrier 20. When the rotation speed of the internal gear 15 in the direction A is set to a predetermined rotation speed lower than the rotation speed of the sun gear 16 in the direction B, the carrier 20 revolves in a direction C and rotates about the own axis in a direction D, as illustrated in FIG. 1.

Here, as illustrated in FIG. 1, the carriers 20 according to the present embodiment are formed using a metal material (e.g., a stainless alloy), engaged with both the internal gear 15 and the sun gear 16, and disposed between the internal gear 15 and the sun gear 16 at given intervals in a circumferential direction. In addition, each carrier 20 is provided with the perforations 22 inside for holding the workpiece W. As illustrated in FIG. 1, the carriers 20 are structured into a planetary gear mechanism engaged with the internal gear 15 and the sun gear 16. The internal gear 15 and the sun gear 16 rotate in the same direction at different predetermined rotation speeds, making the carriers 20 rotate (revolve) about the sun gear 16 and rotate about the own axis. In addition, the lower surface plate 13 and the upper surface plate 14 rotate in the opposite directions, causing the polishing pads 17, 18 to slide on the surfaces of each workpiece W. This enables both surfaces of the workpiece W to be polished. While five carriers 20 each with three perforations 22 are configured to be disposed between the internal gear 15 and the sun gear 16 by way of example in the present embodiment, a configuration are not limited to this. Furthermore, the perforations 22 are provided at positions eccentric to the center of each carrier 20. Moreover, the structure of the carriers 20 is not limited to that in which the carriers 20 are engaged with the internal gear 15 and the sun gear 16.

Next, the control unit 40 according to the present embodiment is configured with a CPU and a memory, and operates on the basis of a preset operation program and setting signals input from an operation section. Here, control to adjust rotation speeds of the carriers 20 and the surface plates 13, 14 will be described. A rotation control unit 43 corresponds to the CPU. In addition, a storage section 41 corresponds to the memory. Coordinates of the pass trajectory of the measuring hole 35 and a distance of the measuring hole 35 from a center of each perforation 22 (workpiece W) during polishing (hereinafter, often simply referred to as "pre-data") are stored in the storage section 41. The rotation control unit 43 is configured to control rotation speeds (numbers of rotations) of the rotary drives 58, 61 through an output section 44 so that the rotation speed (number of rotations) of the carrier 20 is decreasing when the measuring hole 35 passes through the vicinity of the center of the workpiece W (data acquisition range) and the thickness measuring sensor 34 can acquire the thickness or thickness distribution of the workpiece W through the measuring hole 35. That is, the control unit 40 is configured to adjust (including reducing the speed, making the speed constant, and accelerating the speed) the internal gear 15 or the sun gear 16 (including a case of both the internal gear 15 and the sun gear 16) to reduce the rotation speed (number of rotations) of the carrier 20. In addition, the rotation control unit 43 may be configured to control the rotation speeds (numbers of rotations) of the rotary drives 55, 62 through the output section 44 so that the upper surface plate 14 or the lower surface plate 13 on which the measuring hole 35 is provided is decelerating in the above case. That is, the control unit 40 is configured to reduce the rotation speed (number of rotations) of the upper surface plate 14 or the lower surface plate 13 on which the measuring hole 35 is provided. Decelerating the carriers 20 or the surface plates 13, 14 (including a case of both of the surface plates 13, 14) enables the thickness or thickness distribution to be acquired correctly and precisely. Furthermore, the measuring interval of measuring the pass trajectory of passing the vicinity of the center of the workpiece W (data acquisition range) can be reduced, enabling the acquisition of the highly precise thickness distribution. When the workpiece W is the triangular, rectangular, square, or polygonal flat plate workpiece W, the storage section 41 may be configured to store the coordinates of the pass trajectory of the measuring hole 35 and the distance of the measuring hole 35 from the center of the circumscribed circle of all vertexes of the perforation 22 (workpiece W). That is, the control unit 40 may be configured to reduce the rotation speeds (numbers of rotations) of the carriers 20 and the surface plates 13, 14 when the measuring hole 35 passes through the vicinity the center of the workpiece W (data acquisition range) and the measuring hole 35 or the thickness measuring sensor 34 passes through the region of the circumscribed circle.

Furthermore, the main body 12 according to the present embodiment is configured with a slurry supply device (not illustrated) supplying a slurry. With this configuration, settings can be made appropriately for the supply (including non-supply) of the slurry in machining processes, depending on a material and machining conditions of the workpiece W.

Moreover, the main body 12 may be configured with, for example, a well-known carrier detection sensor (not illustrated) in the measuring hole 35. With this configuration, it is possible to detect the carriers 20 during polishing and detect a time when the thickness measuring sensor 34 passes through an actual measurement boundary portion between each carrier 20 and the workpiece W. Therefore, the correct time of a moment when the thickness measuring sensor 34 passes on the workpiece W can be acquired. In addition, even if a slurry film is formed on the carrier 20, the carrier 20 is detected and it can be determined that the thickness is a thickness of the slurry on the carrier 20.

As illustrated in FIG. 4, the thickness measuring section 30 according to the present embodiment is configured with, for example, a laser light source 31, a circulator 32, a laser sensor (e.g., probe) 34 serving as the thickness measuring sensor 34, a photodiode 36, and a data collector 37. It is noted that the thickness measuring sensor (probe) 34 is provided at a position opposed to the upper surface plate 14 (that is, fixed position) on the support frame 28. That is, in the present embodiment, the thickness measuring sensor (probe) 34 is fixed to the support frame 28 and, therefore, not rotated together with the upper surface plate 14 or the lower surface plate 13. The thickness measuring sensor (probe) 34, which is fixed to the support frame 28, can acquire the thickness of the workpiece W without being affected by rotations and vibrations of the surface plates 13, 14. A laser light is emitted to the workpiece W during polishing from the laser light source 31 through the measuring hole 35 and reflected by a front surface of the window, a back surface of the window, the front surface of the workpiece W, and the back surface of the workpiece W. Interference light from the front and back surfaces of the workpiece W is observed as electrical signals (hereinafter, referred to as "interference light signals") among these reflected light, allowing for acquisition of time series data about the thickness of the workpiece W. The time series data about the thickness is output to a thickness computing section 42 to be described later. Disposing positions of the measuring hole 35 and the thickness measuring sensor 34 will be described in (Disposing Range of Thickness Measuring Sensor) in detail.

It is noted that the measuring hole 35 may be configured to be provided on the lower surface plate 13 (not illustrated). In this case, the thickness measuring sensor (probe) 34 is configured to be provided at a position opposed to the lower surface plate 13 on the support frame (not illustrated) closer to the lower surface plate 13. In addition, since the lower surface plate 13 rotates, the thickness measuring sensor 34 and the measuring hole 35 are configured to overlap each other in a plan view in a predetermined rotation phase.

Furthermore, the thickness measuring section 30 is not limited to a type using the laser light. As another example, a diffused light source or an ultrasonic generation source may be adopted as an alternative to the laser light source and the thickness measuring sensor 34 may be a photoelectric sensor or an ultrasonic sensor. When the ultrasonic sensor is adopted, the thickness of the workpiece W can be measured without being affected by a material and a color of the workpiece W, compared with cases of adopting the laser sensor and the photoelectric sensor.

Next, control for acquiring the thickness of the workpiece W will be described. The thickness computing section 42 corresponds to the CPU of the control unit 40. By associating the pre-data read from the storage section 41 with the thickness time series data, the thickness computing section 42 can acquire the thickness distribution of the workpiece W per pass trajectory.

(Disposing Range of Thickness Measuring Sensor)

The main body 12, the thickness measuring section 30, and the control unit 40 of the double-sided polishing apparatus 10 described above can polish the two surfaces of the workpiece W and acquire the thickness of the workpiece W. Next, the disposing range of the measuring hole 35 and the thickness measuring sensor 34 according to the present embodiment will be described. The center of the workpiece W and the vicinity of the center of the workpiece W (data acquisition range) are actually like a complicated trajectory such as a trochoid curve. For the present embodiment, residence time at the center of the workpiece W and the vicinity of the center of the workpiece W (data acquisition range) at each position may be considered. A horizontal axis is defined as a time and a vertical axis is defined as a distance from the center of the lower surface plate 13 or the upper surface plate 14. In this case, when the carrier 20 rotates about the own axis at a constant speed, a trajectory of the center of the workpiece W is a sine wave curve illustrated in FIG. 2. Furthermore, a trajectory of the vicinity of the center of the workpiece W (data acquisition range) is a sine wave region illustrated in FIG. 2. As a result of a dedicated study by the inventors, it was concluded that the residence time of the center of the workpiece W was the longest when the center of the workpiece W arrived at an innermost circumstance and an outermost circumference (that is, vertexes of a sine wave) of the lower surface plate 13 and the upper surface plate 14, as illustrated in FIG. 2. In contrast, it was concluded that the residence time of the vicinity of the center of the workpiece W (data acquisition range) was the longest when the center of the workpiece W arrived at the vicinity of inside of each vertex of the sine wave curve.

Taking advantages of the features of the trajectory of the vicinity of the center of the workpiece W (data acquisition range), the inventors investigated the following ranges as the disposing positions of the measuring hole 35 and the thickness measuring sensor 34.

The inventors contrived of the following configurations as the disposing range of the measuring hole 35 and the thickness measuring sensor 34 according to the present embodiment (hereinafter, often simply referred to as "first range"). First, there is the shortest or longest distance between the center of the lower surface plate 13 and the upper surface plate 14 and the center of any of the perforations 22 preset by the user (that is, the workpiece W) or the center of the circumscribed circle of all vertexes of any of the perforations 22 preset by the user (workpiece W). The central position of the perforation 22 (workpiece W) or the central position of the circumscribed circle of all vertexes of the perforation 22 (workpiece W) at the position (hereinafter, often simply referred to as "first reference position E") is set as a reference. It is noted that the user presets the first distance G that is a predetermined length within 30% of the radius of the perforation 22 (workpiece W) or the radius of the circumscribed circle of all vertexes of the perforation 22 (workpiece W), to correspond to the data acquisition range. In addition, a position apart from the first reference position E by half the first distance G in a direction of the center of the carrier 20 (rotation center) (hereinafter, often simply referred to as "second reference position F") is set as a reference. With the second reference position F as a center, the measuring hole 35 and the thickness measuring sensor 34 are disposed in a range of the first distance G. More specifically, the measuring hole 35 is provided on the upper surface plate 14 or the lower surface plate 13 to fall within the first range in a plan view. In addition, the thickness measuring sensor 34 is disposed on the support frame 28 to fall within the first range in a plan view.

This can increase frequency with which the measuring hole 35 and the thickness measuring sensor 34 pass through the data acquisition range preset by the user.

Furthermore, it is preferable that the central position of the perforation 22 (workpiece W) or the center position of the circumscribed circle of all vertexes of the perforation 22

(workpiece W) at which the distance between the center of the upper surface plate 14 or the lower surface plate 13 and the center of the perforation 22 (workpiece W) or the center of the circumscribed circle of the perforation 22 is the shortest is set as the first reference position E. The measuring hole 35 and the thickness measuring sensor 34 can be disposed on the inner circumferential side of the upper surface plate 14 or the lower surface plate 13, causing a passing speed (circumferential speed) of the measuring hole 35 when the measuring hole 35 passes on the workpiece W to be lower than a case where the measuring hole 35 and the thickness measuring sensor 34 are disposed on an outer circumferential side of the upper surface plate 14 or the lower surface plate 13. Therefore, the thickness of the workpiece W can be acquired correctly and precisely. In addition, a measuring interval of measuring the thickness of the workpiece W becomes smaller, enabling the acquisition of the highly precise thickness distribution.

Second Embodiment

Figure 6:
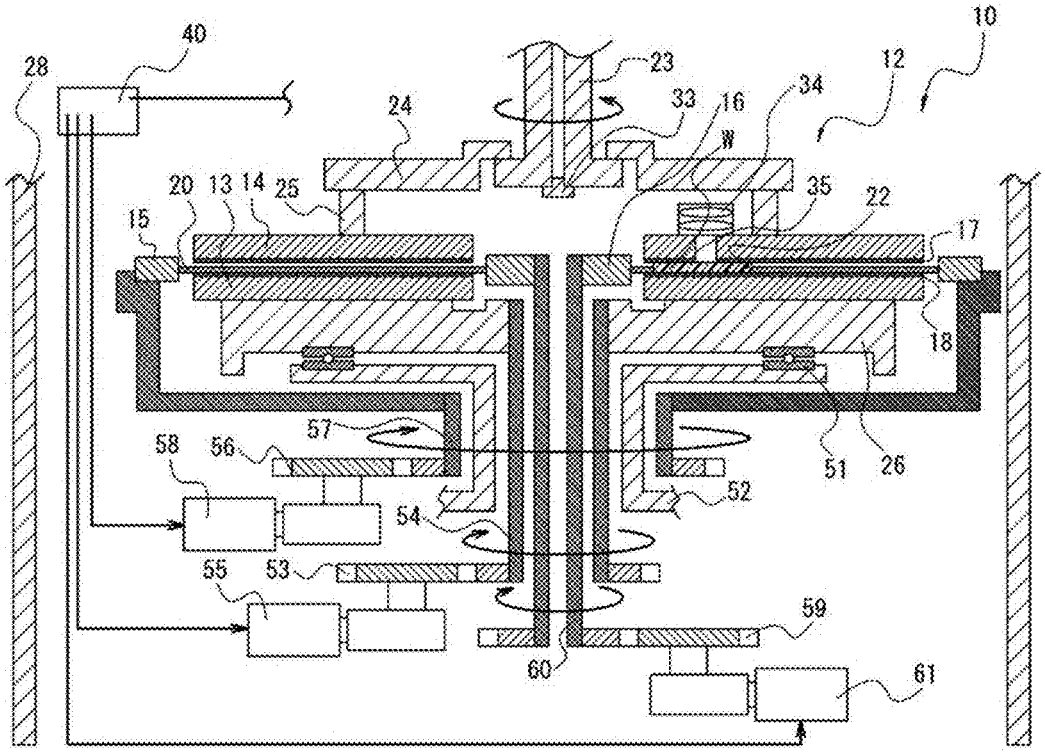
FIG. 6 is a front view of a double-sided polishing apparatus according to a second embodiment of the present invention.
Figure 7:
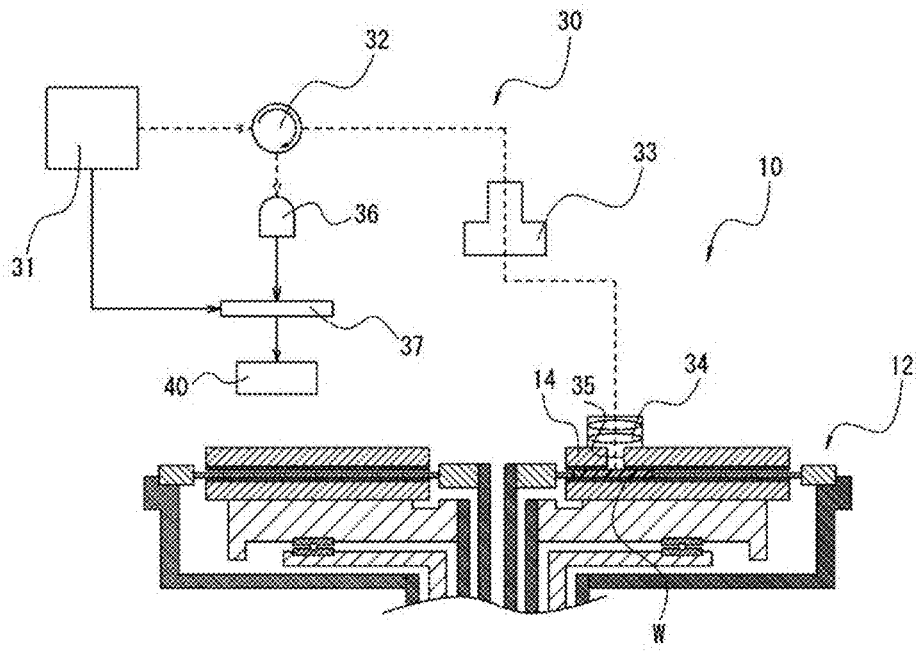
FIG. 7 is a block diagram of the thickness measuring section in the double-sided polishing apparatus illustrated in FIG. 6.

A second embodiment of the present invention will next be described while mainly focusing on differences from the first embodiment. The double-sided polishing apparatus 10 according to the second embodiment has the configurations illustrated in FIGS. 6 and 7 and different from the configurations of the double-sided polishing apparatus 10 according to the first embodiment. That is, the thickness measuring sensor (probe) 34 is provided on the measuring hole 35 of the upper surface plate 14 or the lower surface plate 13. It is noted that FIGS. 6 and 7 illustrate a case where the thickness measuring sensor (probe) 34 is provided on the measuring hole 35 of the upper surface plate 14. In the first embodiment, the thickness measuring sensor (probe) 34 is provided on the support frame 28 and, therefore, fixed. In contrast, in the present embodiment, the thickness measuring sensor (probe) 34 is configured to rotate together with the upper surface plate 14 or the lower surface plate 13 (that is, the thickness measuring sensor (probe) 34 is configured to be provided at a movable position). Furthermore, while the rotary drive 62 and the vertical movement drive 63 are not illustrated in FIG. 6, the control unit 40 is also connected to the rotary drive 62.

The measuring hole 35 and the thickness measuring sensor 34 according to the present embodiment may be provided in a similar range to the range according to the first embodiment in a plan view. More specifically, the measuring hole 35 and the thickness measuring sensor 34 are provided on the upper surface plate 14 or the lower surface plate 13 to fall within the first range in a plan view. In addition, it is preferable that the central position of the perforation 22 (workpiece W) at which the distance between the center of the upper surface plate 14 or the lower surface plate 13 and the center of the perforation 22 (workpiece W) is the shortest, is set as the first reference position E.

It is noted that the thickness measuring section 30 according to the present embodiment is configured with a rotary joint 33 as illustrated in FIG. 7 since the thickness measuring sensor 34 rotates together with the upper surface plate 14 or the lower surface plate 13 unlike the first embodiment.

The control unit 40 is configured to reduce the rotation speed of the carrier 20 when the measuring hole 35 or the thickness measuring sensor 34 passes through the vicinity of the center of the workpiece W (data acquisition range) during actual polishing. That is, the control unit 40 is configured to adjust the rotation speed (number of rotations) of the internal gear 15 or the sun gear 16 (including a case of both the internal gear 15 and the sun gear 16) to reduce the rotation speed of the carrier 20. In addition, the control unit 40 may be configured to decelerate the upper surface plate 14 or the lower surface plate 13 on which the measuring hole 35 is disposed. Decelerating the carriers 20 or the surface plate 13, 14 (including a case of both of the surface plates 13, 14) enables the thickness or thickness distribution to be acquired correctly and precisely. Furthermore, the measuring interval of measuring the pass trajectory of passing the vicinity of the center of the workpiece W (data acquisition range) can be reduced, enabling the acquisition of the highly precise thickness distribution. In the second embodiment, unlike the first embodiment, the thickness measuring sensor 34 rotates together with the upper surface plate 14 or the lower surface plate 13. Therefore, whenever the measuring hole 35 or the thickness measuring sensor 34 passes through the vicinity of the center of the workpiece W (data acquisition range), the thickness or thickness distribution of the workpiece W can be acquired. When the workpiece W is the triangular, rectangular, square, or polygonal flat plate workpiece W, the storage section 41 may be configured to store the coordinates of the pass trajectory of the measuring hole 35 and the distance of the measuring hole 35 from the center of the circumscribed circle of all vertexes of the perforation 22 (workpiece W) during polishing in the second embodiment like the first embodiment. That is, the control unit 40 may be configured to reduce the rotation speeds (numbers of rotations) of the carriers 20 and the surface plate 13, 14 when the measuring hole 35 or the thickness measuring sensor 34 passes through the vicinity of the center of the workpiece W (data acquisition range) and the measuring hole 35 or the thickness measuring sensor 34 passes through the region of the circumscribed circle.

Examples (Simulation Method)

Assuming the configurations of the double-sided polishing apparatus 10 according to the second embodiment, a simulation was conducted to calculate the pass frequency with which the measuring hole 35 and the thickness measuring sensor 34 passed through the vicinity of the center of the workpiece W (data acquisition range) at each disposing position of the measuring hole 35 and the thickness measuring sensor 34. The first reference position E at which the distance between the center of the perforation 22 (workpiece W) and the center of the lower surface plate 13 and the upper surface plate 14 was the shortest was set to point zero on the disposing position of the measuring hole 35 and the thickness measuring sensor 34. Assuming the disposing locations of the measuring hole 35 and the thickness measuring sensor 34 per predetermined intervals, the number of times by which the measuring hole 35 and the thickness measuring sensor 34 pass through the vicinity of the center of the workpiece W (data acquisition range) was counted. In results illustrated in FIGS. 8 to 11, the vertical axis indicates the pass frequency of the thickness measuring sensor 34 and a value at the maximum number of times of passing is set to one. General-purpose numerical calculation software was used for the simulation. In addition, simulation conditions were set as described later.

Example 1

The outside diameter of the workpiece W was φ 200 mm, and the three perforations 22 provided in one carrier 20 were set to be disposed symmetrically at the center of the carrier 20. The center of the workpiece W was set apart from the center of the carrier 20 by 140 mm. The distance between the center of the carrier and the center of the lower surface plate 13 and the upper surface plate 14 was set to 460 mm. That is, the distance between the center of the workpiece W and the center of the lower surface plate 13 and the upper surface plate 14 when the workpiece W was located on the innermost circumference was 320 mm, while the distance between the center of the workpiece W and the center of the lower surface plate 13 and the upper surface plate 14 when the workpiece W was located on the outermost circumference was 600 mm.

It was set that as the internal gear 15 rotated at 5.5 rpm in the direction A and the sun gear 16 rotated at 17 rpm in the direction B, the carrier 20 revolved about the center of the lower surface plate 13 and the upper surface plate 14 at the revolving speed of approximately 8 rpm in the direction C and rotated about the own axis at the rotation speed of approximately 1 rpm in the direction D. It was also set that the surface plate 13, 14 on which the sensor was mounted rotated at 12 rpm (at a relative speed of 20 rpm to the speed of the carrier 20) in the opposite direction to the revolution direction of the carrier 20. In this simulation, it was assumed that rotations were transmitted without an influence of a backlash or the like.

Furthermore, the rotation speeds of the internal gear 15, the sun gear 16, and the surface plates 13, 14 vary depending on a polishing stage in actual polishing. However, Example 1 relates to the simulation and the rotation speeds are all constant. That is, the simulation according to the present example was carried out, assuming that the carrier 20 rotated and revolved at constant speeds and the surface plate 13, 14 rotates at the constant speed.

In the simulation, each carrier 20 was rotated at the constant speed from an arbitrary initial state (any initial state of a phase of each carrier 20 may be used), and the number of times by which the measuring hole 35 and the thickness measuring sensor 34 passed through the vicinity of the center of the workpiece W (data acquisition range) within five minutes was counted. The vicinity of the center of the workpiece W (data acquisition range) in the present example was set to 10 15 mm from the center of the perforation 22 (workpiece W) (corresponding to within 10% of the radius of the perforation 22 (workpiece W)). The first distance G was also set to 10 mm.

(Simulation Result 1)

Figure 8:
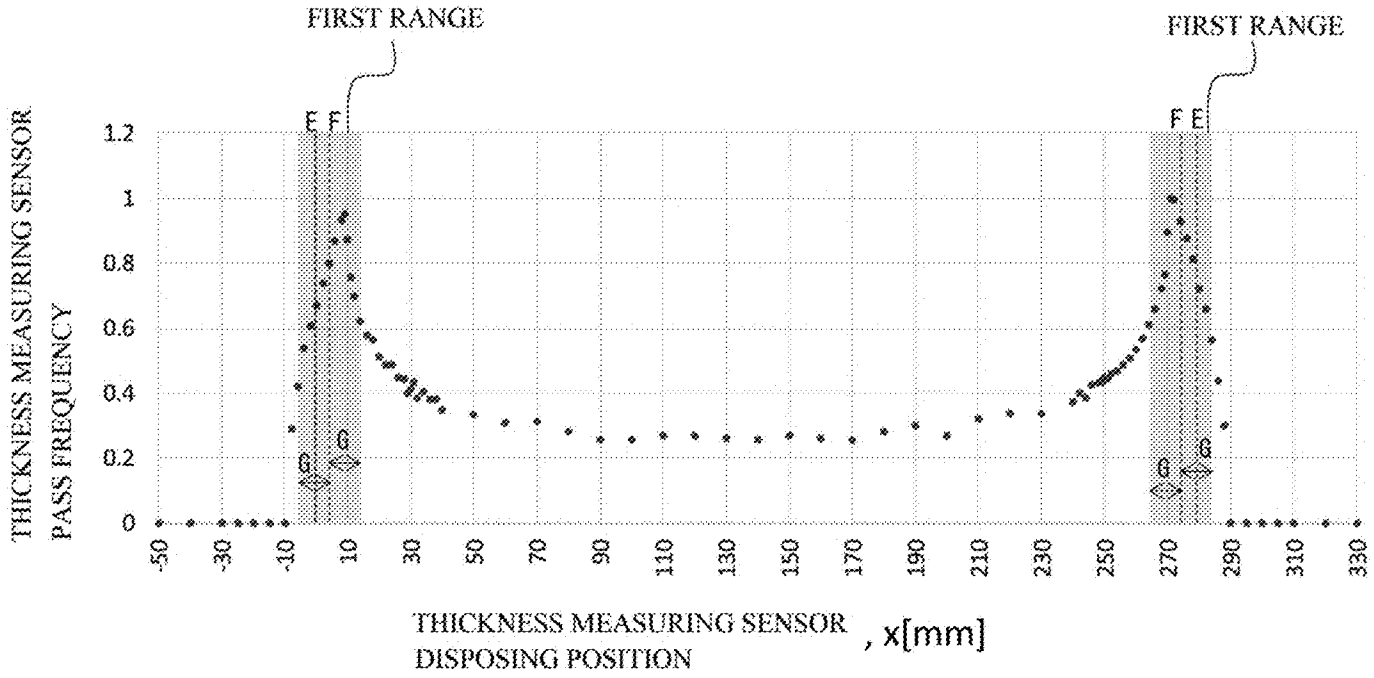
FIG. 8 is a graph illustrating a frequency with which a pass trajectory passes near the center of the workpiece (data acquisition range) according to Example 1.

FIG. 8 illustrates a result. The first reference position E is where the thickness measuring sensor disposing position x is 0 mm and 280 mm. The second reference position F is where the thickness measuring sensor disposing position x is 5 mm and 275 mm. The first range is −5 mm≤x≤15 mm and 265 mm≤x≤285 mm (corresponding to shaded ranges in FIG. 8, respectively). As illustrated in FIG. 8, it was confirmed that in each first range, the pass frequency peaked near a position apart by the first distance G from the first reference position E to the center of the carrier 20. As illustrated in FIG. 8, it was also confirmed that the pass frequency decreased from each peak to the center of the carrier 20 and converged into a constant value (hereinafter, often simply referred to as "convergence value"). That is, the pass frequency varied in an aspect of a bathtub curve between the peaks. It was further confirmed that the pass frequency of the thickness measuring sensor 34 monotonically decreased from each peak to outside of the carrier 20. The first ranges each contain the peak and the pass frequency was higher than the convergence value in the bathtub curve. Therefore, if disposing the thickness measuring sensor 34 in the first range, the higher pass frequency than the convergence value can be obtained. To make the pass frequency of passing through the vicinity of the center of the workpiece W (data acquisition range) the highest when the distance specifying the data acquisition range was equal to the first distance G, it was confirmed that the thickness measuring sensor 34 could be disposed near the position apart by the first distance G from the first reference position E to the center of the carrier 20.

Example 2

Subsequently, a simulation was carried out when the data acquisition range was set to 30 mm from the center of the perforation 22 (workpiece W) (corresponding to within 30% of the radius of the perforation 22 (workpiece W)) under similar conditions to the conditions of Example 1. The first distance G was also set to 30 mm.

(Simulation Result 2)

Figure 9:
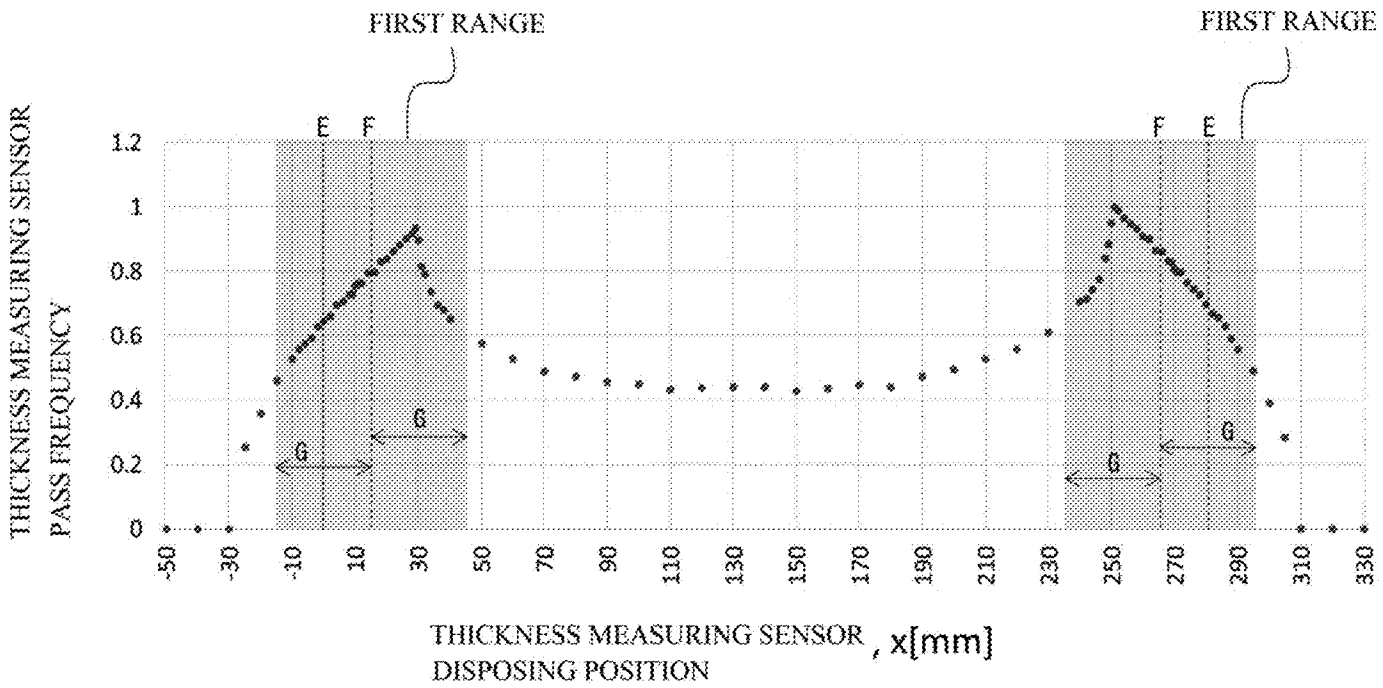
FIG. 9 is a graph illustrating a frequency with which a pass trajectory passes near the center of the workpiece (data acquisition range) according to Example 2.

FIG. 9 illustrates a result. The first reference position E is where the thickness measuring sensor disposing position x is 0 mm and 280 mm. The second reference position F is where the thickness measuring sensor disposing position x is 15 mm and 265 mm. The first range is −15 mm≤x≤45 mm and 235 mm≤x≤295 mm (correspond to shaded ranges in FIG. 9, respectively). Like Example 1, it was confirmed that in each first range, the pass frequency peaked near a position apart by the first distance G from the first reference position E to the center of the carrier 20. As illustrated in FIG. 9, it was also confirmed that the pass frequency decreased from each peak to the center of the carrier 20 and converged into the convergence value, and that the pass frequency varied in the aspect of the bathtub curve between the peaks. It was further confirmed that the pass frequency of the thickness measuring sensor 34 monotonically decreased from each peak to outside of the carrier 20. The first ranges each contained the peak and the pass frequency was higher than the convergence value in the bathtub curve. Therefore, if disposing the thickness measuring sensor 34 in the first range, the higher pass frequency than the convergence value can be obtained. Furthermore, in Example 2, like Example 1, to make the pass frequency of passing through the vicinity of the center of the workpiece W (data acquisition range) the highest when the distance specifying the data acquisition range was equal to the first distance G, it was confirmed that the thickness measuring sensor 34 could be disposed near the position apart by the first distance G from the first reference position E to the center of the carrier 20. It is estimated from the simulation results of Examples 1 and 2 that for the workpiece W at φ 200 mm, a conspicuous effect can be obtained in a range from the second reference position F to the first distance G, irrespective of the vicinity of the center of the workpiece W (data acquisition range).

Example 3

Subsequently, the outside diameter of the workpiece W was set to φ 75 mm The center of the workpiece W was set to be apart from the center of the carrier 20 by 53 mm. The distance between the center of the carrier and the center of the lower surface plate 13 and the upper surface plate 14 was set to 220 mm. That is, the distance between the center of the workpiece W and the center of the lower surface plate 13 and the upper surface plate 14 when the workpiece W was located on the innermost circumference was 167 mm, while the distance between the center of the workpiece W and the center of the lower surface plate 13 and the upper surface plate 14 when the workpiece W was located on the outermost circumference was 273 mm.

It was also set that as the internal gear 15 rotated at 5.4 rpm and the sun gear 16 rotated at 15 rpm, the carrier 20 revolved at the revolving speed of approximately 8 rpm and rotated about the own axis at the rotation speed of approximately 1 rpm.

The vicinity of the center of the workpiece W (data acquisition range) was set to 5 mm from the center of the perforation 22 (workpiece W) (corresponding to within 14% of the radius of the perforation 22 (workpiece W)). The first distance G was also set to 5 mm.

Furthermore, the other simulation conditions are similar to those in Examples 1 and 2.

(Simulation Result 3)

Figure 10:
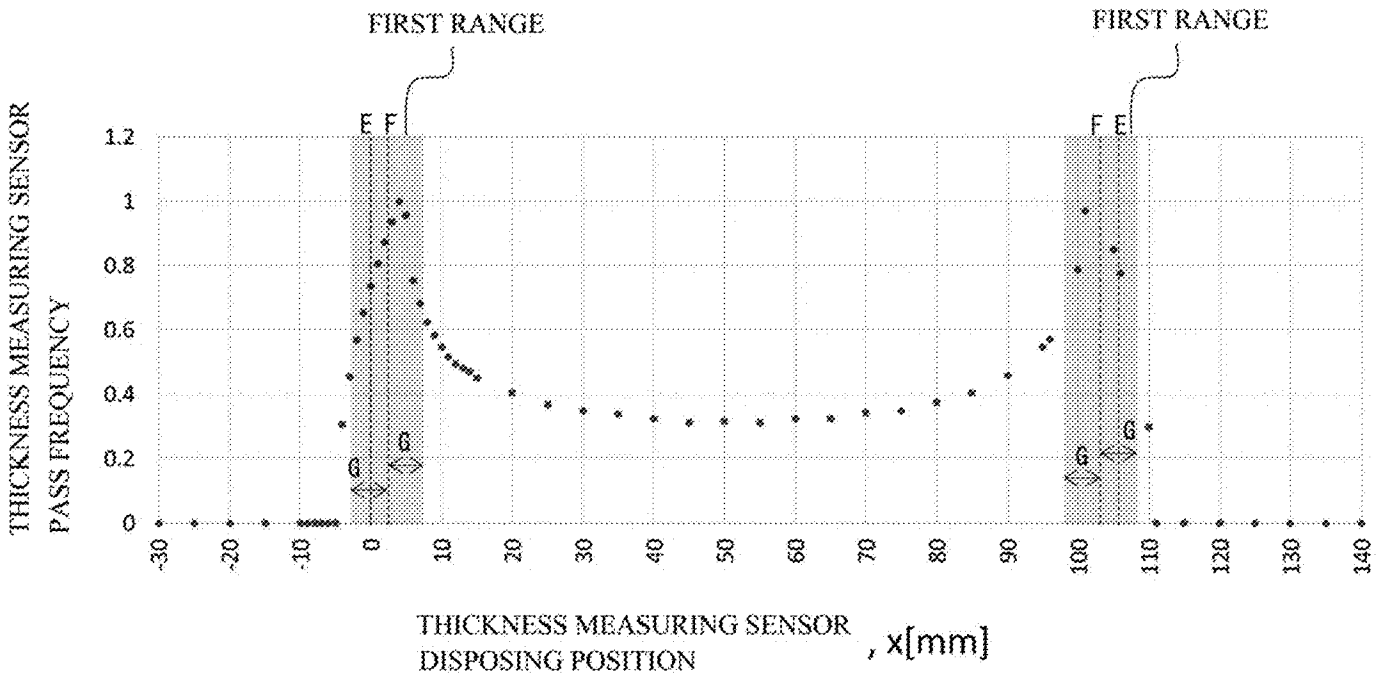
FIG. 10 is a graph illustrating a frequency with which a pass trajectory passes near the center of the workpiece (data acquisition range) according to Example 3.

FIG. 10 illustrates a result. The first reference position E is where the thickness measuring sensor disposing position x is 0 mm and 106 mm. The second reference position F is where the thickness measuring sensor disposing position x is 2.5 mm and 103.5 mm. The first range is $-2.5\ \text{mm} \leq x \leq 7.5$ mm and $98.5\ \text{mm} \leq x \leq 108.5$ mm (correspond to shaded ranges in FIG. 10, respectively). Like Examples 1 and 2, it was confirmed that in each first range, the pass frequency peaked near a position apart by the first distance G from the first reference position E to the center of the carrier 20. It was also confirmed that the pass frequency decreased from each peak to the center of the carrier 20 and converged into the convergence value, and that the pass frequency varied in the aspect of the bathtub curve between the peaks. It was further confirmed that the pass frequency of the thickness measuring sensor 34 monotonically decreased from each peak to outside of the carrier 20. The first ranges each contained the peak and the pass frequency was higher than the convergence value in the bathtub curve. Therefore, if disposing the thickness measuring sensor 34 in the first range, the higher pass frequency than the convergence value can be obtained. Furthermore, in Example 3, like Examples 1 and 2, to make the pass frequency of passing through the vicinity of the center of the workpiece W (data acquisition range) the highest when the distance specifying the data acquisition range was equal to the first distance G, it was confirmed that the thickness measuring sensor 34 could be disposed near the position apart by the first distance G from the first reference position E to the center of the carrier 20.

Example 4

Subsequently, a simulation in a case where the first distance G was set to 10 mm was carried out when the data acquisition range was set to 10 mm from the center of the perforation 22 (workpiece W) (corresponding to within 27% of the radius of the perforation 22 (workpiece W)) under similar conditions to the conditions of Example 3.

(Simulation Result 4)

Figure 11:
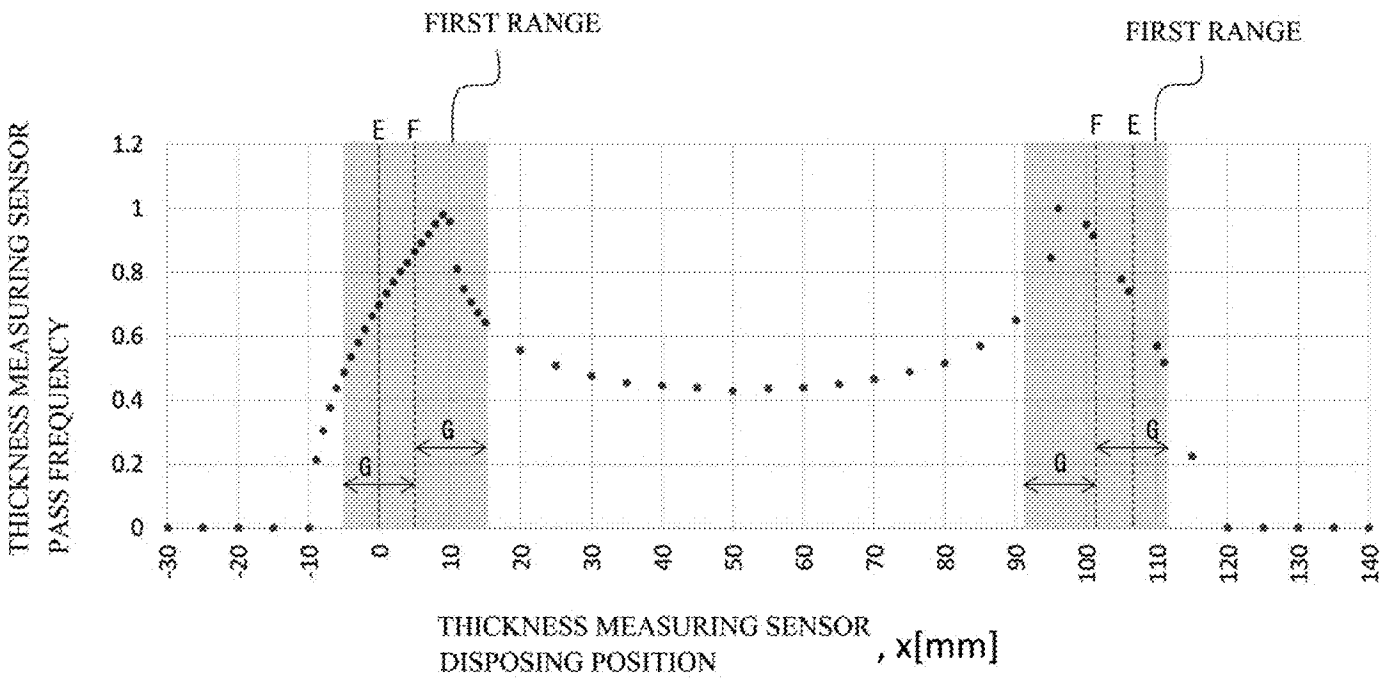
FIG. 11 is a graph illustrating a frequency with which a pass trajectory passes through near the center of the workpiece (data acquisition range) according to Example 4.

FIG. 11 illustrates a result. The first reference position E is where the thickness measuring sensor disposing position x is 0 mm and 106 mm. The second reference position F is where the thickness measuring sensor disposing position x is 5 mm and 101 mm. The first range is $-5\ \text{mm} \leq x \leq 15$ mm and $91\ \text{mm} \leq x \leq 111$ mm (correspond to shaded ranges in FIG. 11, respectively). Like Examples 1 to 3, it was confirmed that in each first range, the pass frequency peaked near a position apart by the first distance G from the first reference position E to the center of the carrier 20. It was also confirmed that the pass frequency decreased from each peak to the center of the carrier 20 and converged into the convergence value, and that the pass frequency varied in the aspect of the bathtub curve between the peaks. It was further confirmed that the pass frequency of the thickness measuring sensor 34 monotonically decreased from each peak to outside of the carrier 20. The first ranges each contained the peak and the pass frequency was higher than the convergence value in the bathtub curve. Therefore, if disposing the thickness measuring sensor 34 in the first range, the higher pass frequency than the convergence value can be obtained. Furthermore, in Example 4, like Examples 1 to 3, to make the pass frequency of passing through the vicinity of the center of the workpiece W (data acquisition range) the highest when the distance specifying the data acquisition range was equal to the first distance G, it was confirmed that the thickness measuring sensor 34 could be disposed near the position apart by the first distance G from the first reference position E to the center of the carrier 20. It is estimated from the simulation results of Examples 1 and 4 that a similar effect can be obtained when the first distance G is set within 30% of the radius of the workpiece W (e.g., equal to the distance specifying the data acquisition range), irrespective of the diameter of the perforation 22 (workpiece W). It is estimated that for the workpiece W at the diameter of, for example, φ 300 and φ 400, a similar effect can be obtained by disposing the thickness measuring sensor 34 in the first range. It is also preferable to set the first distance G to satisfy (⅔ of distance specifying data acquisition range)≤(First distance G)≤(Distance specifying data acquisition range). This is because the first range always contains the peak of the pass frequency of the thickness measuring sensor 34 and the measuring hole 35 or the thickness measuring sensor 34 can be disposed in the range in which the pass frequency falling within the first range is higher.

The simulation results have been described so far. It is estimated that actual polishing (the rotation speed of the carrier 20 is not constant) has a similar effect (the pass frequency of each position can be obtained in a similar tendency to that in Examples 1 to 4 despite the different pass frequency within five minutes). To make the pass frequency of passing near the center of the workpiece W (data acquisition range) the highest, when the distance specifying the data acquisition range is equal to the first distance G, the thickness measuring sensor 34 may be disposed near the position apart by the first distance G from the first reference position E to the center of the carrier 20. Furthermore, it was assumed in the present simulations that the thickness measuring sensor 34 was provided on the upper surface plate 14. A similar effect can be obtained even with the thickness measuring sensor 34 provided on the support frame 28 (that is, the thickness measuring sensor 34 is at the fixed position). In addition, even when the workpiece W is a triangular, rectangular, square, or polygonal flat plate workpiece W, the circumscribed circle of all vertexes of the workpiece W may be regarded as the region of the workpiece W, and the first distance G and the first range may be set on the basis of the radius and the central position of the circumscribed circle. In this case, it is estimated that a similar effect to that for the disk-shaped workpiece W (Examples 1 to 4) can be obtained. In addition, when the workpiece W is a triangular, rectangular, square, or polygonal flat plate workpiece W, an inscribed circle of the shape (a predetermined inscribed circle for the rectangle) may be regarded as the region of the workpiece W, and the first distance G and the first range may be set on the basis of a radius and a central position of the inscribed circle. In this case, it is estimated that a similar effect to that for the disk-shaped workpiece W (Examples 1 to 4) can be obtained.

The present invention is not limited to the embodiments described so far and can be changed and modified in various manners without departing from the present invention. By way of example, the thickness measuring sensor 34 may be provided at a fixed position in a location other than the support frame 28, the upper surface plate 14, and the lower surface plate 13. More specifically, the thickness measuring sensor 34 may be configured to be provided at the fixed position in a predetermined space between the upper surface plate 14 or lower surface plate 13 and the support frame 28. Alternatively, the thickness measuring sensor 34 may be configured to be provided rotatably in a predetermined space between the upper surface plate 14 or lower surface plate 13 and the support frame 28. More specifically, the thickness measuring sensor 34 may be configured to be provided in a predetermined space between the upper surface plate 14 or lower surface plate 13 and the support frame 28 and provided on a rotation member (not illustrated) rotating synchronously with the upper surface plate 14 or the lower surface plate 13.

Reference Signs List

What is claimed is:

1. A double-sided polishing apparatus comprising:

a lower surface plate;

an upper surface plate; and a carrier disposed between the lower surface plate and the upper surface plate and holding a disk-shaped workpiece, wherein the carrier is configured to rotate about a center of the lower surface plate and the upper surface plate and to rotate about a center of the carrier, the double-sided polishing apparatus comprises a thickness measuring sensor at a fixed position above the upper surface plate or below the lower surface plate or at a movable position in an upper portion of the upper surface plate or a lower portion of the lower surface plate, the carrier includes circular perforations each holding the workpiece at a position eccentric to the center of the carrier, when a central position of any of the perforations preset by a user is defined as a first reference position, with a distance between a center of the upper surface plate or the lower surface plate and a center of any of the perforations preset by the user being shortest or longest, and a position apart from the first reference position by half of a first distance in a direction of the center of the carrier is defined as a second reference position, with the first distance being a predetermined length within 30% of a radius of the perforation, then the thickness measuring sensor is provided in a range of the first distance about the second reference position in a plan view, and the thickness measuring sensor is configured to measure a thickness of the workpiece in a state in which the workpiece is held in the perforation, through a measuring hole provided on the upper surface plate or the lower surface plate closer to a side on which the thickness measuring sensor is disposed.

2. The double-sided polishing apparatus according to claim 1, wherein the central position of the perforation at which a distance between the center of the upper surface plate or the lower surface plate and the center of the perforation is the shortest is set as the first reference position.

3. The double-sided polishing apparatus according to claim 1, further comprising a control unit, wherein the control unit is configured such that when a pass trajectory of the measuring hole or the thickness measuring sensor of passing through the workpiece is within a predetermined range from the center of the perforation and passes through a data acquisition range present by the user, the control unit reduces a rotation speed of the carrier corresponding to the pass trajectory to be lower than a rotation speed of the carrier corresponding to the other pass trajectory.

4. The double-sided polishing apparatus according to claim 1, wherein the thickness measuring sensor is configured such that at the fixed position, the thickness measuring sensor is provided on a support frame located above the upper surface plate or the support flame located below the lower surface plate, and measures a thickness of the workpiece in a state of being held in the perforation through the measuring hole, or configured such that at the movable position, the thickness measuring sensor is provided on the upper surface plate or the lower surface plate to rotate together with the upper surface plate or the lower surface plate, and measures the thickness of the workpiece in the state of being held in the perforation through the measuring hole.

5. A double-sided polishing apparatus comprising:

a lower surface plate;

an upper surface plate; and a carrier disposed between the lower surface plate and the upper surface plate and holding a triangular, rectangular, square, or polygonal flat-plate workpiece, wherein the carrier is configured to rotate about a center of the lower surface plate and the upper surface plate and to rotate about a center of the carrier, the double-sided polishing apparatus comprises a thickness measuring sensor at a fixed position above the upper surface plate or below the lower surface plate or at a movable position in an upper portion of the upper surface plate or a lower portion of the lower surface plate, the carrier includes circular perforations each holding the workpiece at a position eccentric to the center of the carrier and each having an identical shape to the workpiece, when a central position of any of the perforations preset by a user is defined as a first reference position, with a distance between a center of the upper surface plate or the lower surface plate and a center of a circumscribed circle of all vertexes of any of the perforations preset by the user being shortest or longest, and a position apart from the first reference position by half of a first distance in a direction of the center of the carrier is defined as a second reference position, with the first distance being a predetermined length within 30% of a radius of the circumscribed circle, the thickness measuring sensor is provided in a range of the first distance about the second reference position in a plan view, and the thickness measuring sensor is configured to measure a thickness of the workpiece in a state in which the workpiece is held in the perforation, through a measuring hole provided on the upper surface plate or the lower surface plate closer to a side on which the thickness measuring sensor is disposed.

6. The double-sided polishing apparatus according to claim 5, wherein the central position of the circumscribed circle at which a distance between the center of the upper surface plate or the lower surface plate and the center of the circumscribed circle is the shortest is set as the first reference position.

7. The double-sided polishing apparatus according to claim 5, further comprising a control unit, wherein the control unit is configured such that when a pass trajectory of the measuring hole or the thickness measuring sensor of passing through the workpiece is within a predetermined range from the center of the circumscribed circle and passes through a data acquisition range preset by the user, the control unit reduces a rotation speed of the carrier corresponding to the pass trajectory to be lower than a rotation speed of the carrier corresponding to the other pass trajectory.

8. The double-sided polishing apparatus according to claim 5, wherein the thickness measuring sensor is configured such that at the fixed position, the thickness measuring sensor is provided on a support frame located above the upper surface plate or support frame located below the lower surface plate, and measures a thickness of the workpiece in a state of being held in the perforation through the measuring hole, or configured such that at the movable position, the thickness measuring sensor is provided on the upper surface plate or the lower surface plate to rotate together with the upper surface plate or the lower surface plate, and measures the thickness of the workpiece in the state of being held in the perforation through the measuring hole.

* * * * *